United States Patent [19]

Tsao et al.

[11] Patent Number: 4,843,400

[45] Date of Patent: Jun. 27, 1989

[54] APERTURE COUPLED CIRCULAR POLARIZATION ANTENNA

[75] Inventors: Chich-Hsing Tsao; Thomas E. Roberts, both of Saratoga, Calif.

[73] Assignee: Ford Aerospace Corporation, Newport Beach, Calif.

[21] Appl. No.: 230,107

[22] Filed: Aug. 9, 1988

[51] Int. Cl.[4] ..... H01Q 1/38

[52] U.S. Cl. ..... 343/700 MS; 343/829

[58] Field of Search ..... 343/700 MS, 771, 770, 343/767, 768, 725, 729, 829, 846, 848

[56] References Cited

U.S. PATENT DOCUMENTS

| | | | |
|---|---|---|---|
| 3,665,480 | 5/1972 | Fassett | 343/700 MS |
| 4,125,838 | 11/1978 | Kaloi | 343/700 MS |
| 4,125,839 | 11/1978 | Kaloi | 343/700 MS |
| 4,130,822 | 12/1978 | Conroy | 343/700 MS |
| 4,170,013 | 10/1979 | Black | 343/700 MS |
| 4,364,050 | 12/1982 | Lopez | 343/700 MS |
| 4,386,357 | 5/1983 | Patton | 343/700 MS |
| 4,450,449 | 5/1984 | Jewitt | 343/700 MS |
| 4,486,758 | 12/1984 | de Ronde | 343/700 MS |
| 4,489,328 | 12/1984 | Gears | 343/700 MS |
| 4,564,842 | 1/1986 | Suzuki | 343/700 MS |
| 4,613,868 | 9/1986 | Weiss | 343/700 MS |
| 4,651,159 | 3/1987 | Ness | 343/700 MS |
| 4,755,821 | 7/1988 | Itoh et al. | 343/700 MS |

FOREIGN PATENT DOCUMENTS

| | | | |
|---|---|---|---|
| 1008825 | 3/1983 | U.S.S.R. | 343/700 MS |

OTHER PUBLICATIONS

James et al., Microstrip Antenna Theory and Design (1981), p. 202.

*Primary Examiner*—Rolf Hille
*Assistant Examiner*—Michael C. Wimer
*Attorney, Agent, or Firm*—Edward J. Radlo; Keith L. Zerschling

[57] ABSTRACT

A generally planar antenna for generating circularly polarized electromagnetic signals, particularly useful at microwave frequencies. Each antenna element comprises a single excitation aperture (7) cut in a planar conductive ground plane (9). Spaced apart from the ground plane (9) by means of a dielectric layer (11) and covering the excitation aperture (7) is a planar conductive radiating patch (5) having slightly different dimensions along each of two orthogonal axes. The radiating patch (5) may have the shape of a near square or an ellipse. Exciting the aperture (7) with linearly polarized electromagnetic energy causes the radiating patch (5) to generate a circularly polarized electromagnetic signal consisting of two orthogonal components that have substantially the same amplitude and are 90° offset in phase from each other. Several antenna elements can be combined to form a large aperture array. Energy may be applied to the excitation aperture (7) by means of a waveguide (3) feed, microstrip line (15), or stripline (15).

8 Claims, 3 Drawing Sheets

APERTURE COUPLED CIRCULAR POLARIZATION ANTENNA

DESCRIPTION

1. Technical Field

The present invention relates to antennas that generate circularly polarized electromagnetic signals.

2. Background Art

A waveguide slot array is often used at microwave frequencies (e.g., those in excess of 1 GHz) for communications and radar applications. Design techniques for these waveguide slot arrays have been highly refined, so that it is possible to design optimized slot patterns to fit specified coverage requirements. These antennas are very good for linear polarization applications, but they do not directly generate circularly polarized signals. A meanderline polarizer can be located over the slot radiators to convert the linear polarization to circular, and this is often done. However, the resulting structure is quite thick and heavy, because the meanderline polarizer must have at least three quarter-wavelength layers. At an operating frequency in the L-band region, the wavelength is approximately 12 inches, so the total thickness of the meanderline polarizer is 9 inches. The extra thickness complicates stowage and deployment problems, particularly when folding is required. The weight of such a device can also be significant, particularly for spacecraft applications, where weight is always a critical consideration.

In another prior technique to generate circular polarization, a patch array is fed at one corner with microstrip line integrally formed as part of the patch. An example of this technique is found in James et al., *Microstrip Antenna Theory and Design* (1981) at p. 202. The present invention is superior because the radiating apparatus and feed network can each be designed and optimized separately, albeit interdependently. In the reference apparatus, the microstip line itself radiates and contaminates the antenna polarization. Note that in FIG. 7.7(*c*) of the reference, the slot is a tuning slot, rather than an excitation slot as in the present invention.

In another prior technique to generate circular polarization, a patch array is fed at one corner with a probe that is the center conductor of a coaxial transmission line. This technique is not as effective as the present invention because it requires soldering the probe to the patch. This increases production costs compared with the printed circuit technology of the present invention. Furthermore, it increases the potential for mechanical, and hence electrical, failure.

U.S. Pat. No. 4,170,013 discloses a stripline patch antenna in which a patch radiator 17 is supported on a dielectric layer 16 and surrounded by a square cavity 19 cut in an adjacent dielectric layer 26 and in a ground plane 14. There is a direct feed between the radiating patch and a stripline conductor feedline. The present invention differs from the reference antenna in that: (1) circular polarization is generated; (2) the design of the feed network can be optimzed separately from the design of the radiating network; (3) electrical connection between two ground planes is not required; and (4) it is much easier to combine antenna elements into an array because there is no need to cut large apertures in a ground plane and dielectric for each antenna element.

Secondary references are U.S. Pat. Nos. 3,665,480; 4,125,838; 4,125,839; 4,130,822; 4,364,050; 4,386,357; 4,450,449; 4,486,758; 4,489,328; 4,564,842; 4,613,868; and 4,651,159.

DISCLOSURE OF INVENTION

The present invention is an antenna that generates circularly polarized electromagnetic signals. Each antenna element comprises a single excitation aperture (7) cut in a planar conductive ground plane (9). A planar conductive radiating patch (5), having slightly different dimensions (L1,L2; N1,N2) along each of two orthogonal axes, is in spaced parallel relation to the ground plane (9), and covers the excitation aperture (7). A planar dielectric layer (11) separates the ground plane (9) from the radiating patch (5). Viewed from the perspective of the plane of the radiating patch (5), the excitation aperture (7) forms an acute angle with respect to each of the two orthogonal axes of the radiating patch (5). With appropriate values for the dimensions (L1, L2; N1, N2), exciting the aperture (7) with linearly polarized electromagnetic energy causes the radiating patch (5) to generate two orthogonal components of electromagnetic signal that have substantially the same amplitude and are 90° offset in phase from each other.

BREIF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
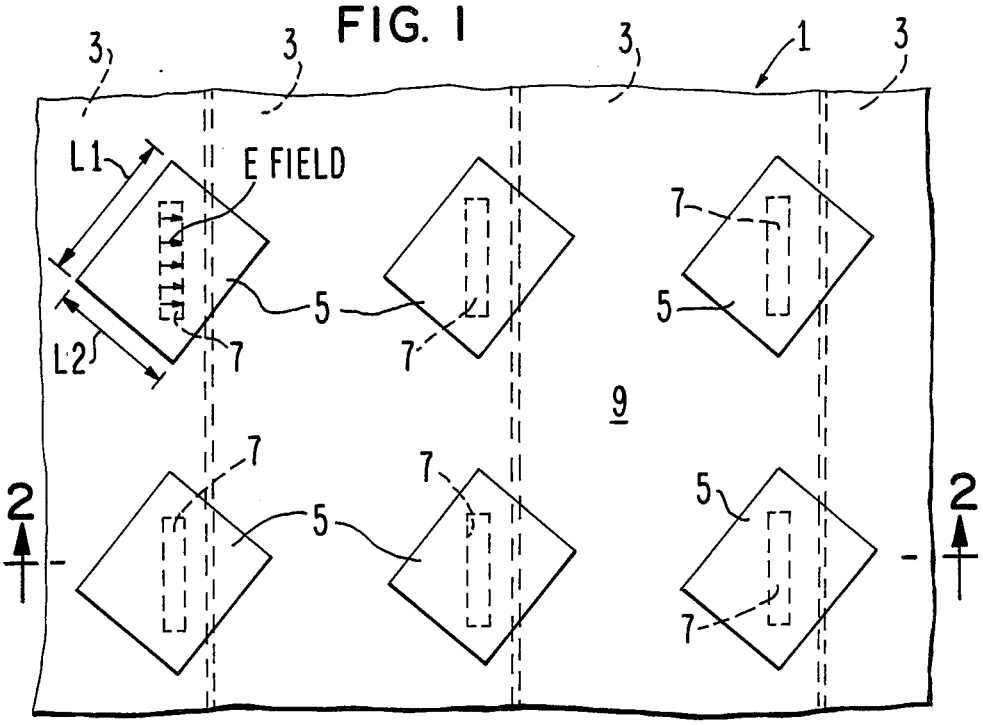
FIG. 1 is a top planar view of a first embodiment of the present invention.

FIG. 1 illustrates a first embodiment of the present invention in which several antenna elements, each identified by a radiating patch 5, are mounted on a single waveguide structure 1 to form an array. The combination in a repeating geometrical pattern of several antenna elements into an array enables the synthesization of a larger aperture than would be available with a single antenna element.

Waveguide ensemble 1 comprises several parallel elongated conductive waveguides 3 which share a common planar upper conductive face 9. Cut into the upper face 9 of each waveguide 3 is a set of colinear elongated excitation (coupling) slots 7. The slots are cut into one of the wider two walls of each waveguide 3 in a shunt fed configuration. The slots 7 are offset from the center axis of each waveguide 3, for proper impedance matching. The E (electric field) vector of the linearly polarized wave within each waveguide 3 is orthogonal to the long dimension of each slot 7, for optimum efficiency.

Coplanar with the upper surface of conductive face 9 is the lower surface of a plananar dielectric layer 11. On the upper surface of layer 11 are placed several planar conductive radiating patches 5. Radiating patches 5 are thin, e.g., 0.001" thick. One patch 5 covers each slot 7. It is permissible for a patch 5 to be situated over two or more adjacent waveguides 3.

Dielectric 11 can be made of any one of a number of substances including PTFE (poly-tetra-fluoro-ethylene). The combination of dielectric 11 plus patches 5 can be fabricated from a copper cladded dielectric; the copper is etched away using a mask to form the radiating patches 5 in the proper shape and orientation.

Figure 2:
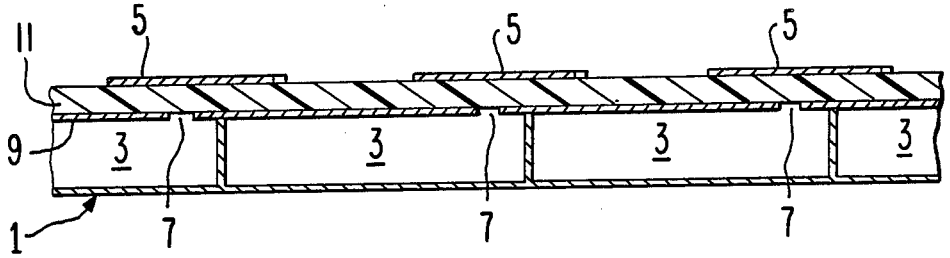
FIG. 2 is a side cross-sectional view corresponding to the FIG. 1 embodiment.

In the FIGS. 1 and 2 embodiment, each radiating patch 5 has the shape of a rectangle that is nearly, but not exactly, a square. A first dimension L1 is slightly greater than a second orthogonal dimension L2. A starting dimension for each side is one-half of the wavelength of the electromagnetic energy present, taking into account the presence of the dielectric layer 11 and the presence of the medium on the radiating side of the antenna (typically freespace). The starting dimension is slightly increased to give L1, and slightly decreased to give L2. The slight increase is equivalent to a slight frequency detune in the inductive direction. The slight decrease is equivalent to a slight frequency detune in the capacitive direction.

Each slot 7 forms substantially a 45° angle with respect to each of the four edges of its associated radiating patch 5 (viewed from the perspective of the plane of patch 5). At each corner, the angle between slot 7 and the relatively long edge of patch 5 is slightly less than 45°, while the angle between slot 7 and the relatively short edge of patch 5 is slightly greater than 45°. This 45° excitation angle causes the generation of two orthogonal components of electromagnetic energy that radiate from patch 5 in a direction away from waveguide ensemble 1. These two components have substantially the same amplitude because of the 45° angle and the fact that L1 is nearly equal to L2, satisfying a first requirement for the generation of circularly polarized signals. It should be noted that the angle may have to be adjusted slightly to a value other than 45° in order to have equal signal amplitudes for the two orthogonal components.

The ratio between L1 and L2, and the dimensions of slot 7, are determined experimentally to give a 90° phase differential between the two components, satisfying a second requirement for the generation of circularly polarized signals.

The circularly polarized bandwidth can be fine-tuned by adjusting the thickness of dielectric layer 11, the dimensions of slot 7, and/or the dielectric constant of layer 11.

Figure 3:
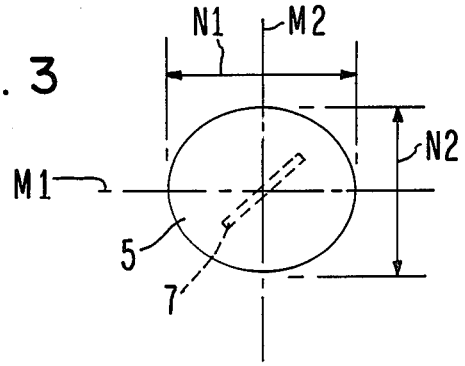
FIG. 3 is an alternative embodiment of radiating patch 5 of the present invention, in which patch 5 is elliptical.

An alternative embodiment is depicted in FIG. 3 in which the shape of each radiating patch 5 is elliptical rather than near square. N1, the dimension of patch 5 along major axis M1, is slightly greater than N2, the dimension of patch 5 along orthogonal minor axis M2. In this embodiment, slot 7 makes a 45° angle to each of major axis M1 and minor axis M2.

The use of patches 5 in combination with dielectric layer 11 enables the realization of a better impedance match for a given bandwidth, or a broader bandwidth for a given impedance, compared with prior art antennas in which the radiating layer and feed are coplanar. This is because the combination of patch 5 and dielectric 11 acts as a load, lowering the Q. The tradeoff is slightly greater loss.

Figure 4:
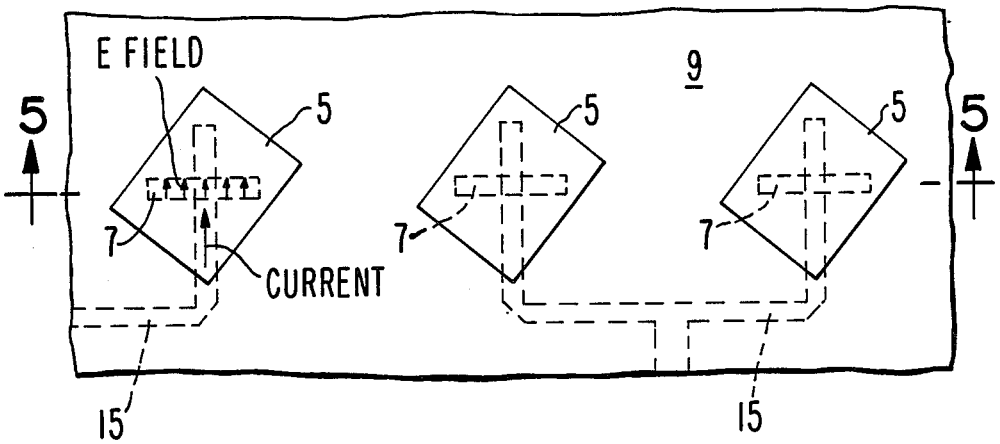
FIG. 4 is a top planar view of a second embodiment of the present invention, in which the excitation network is implemented in microstrip.
Figure 5:
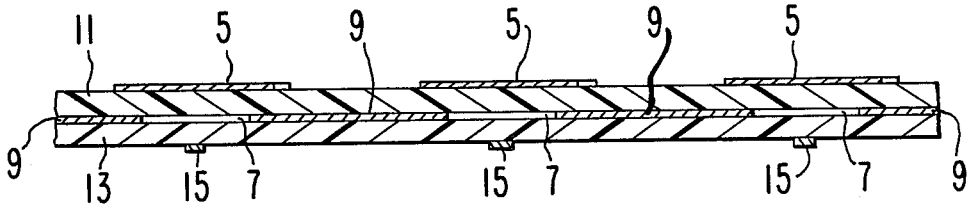
FIG. 5 is a side cross-sectional view corresponding to the FIG. 4 embodiment.
Figure 6:
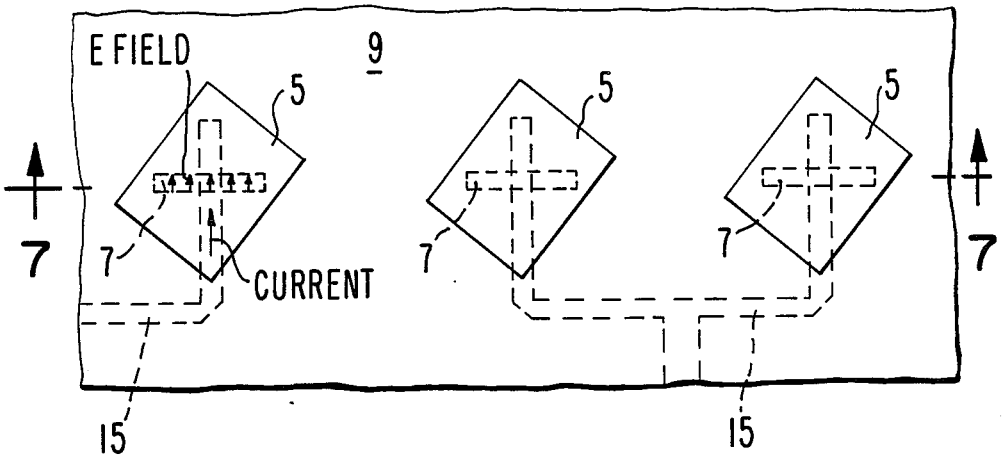
FIG. 6 is a top planar view of a third embodiment of the present invention, in which the excitation means is implemented in stripline.
Figure 7:
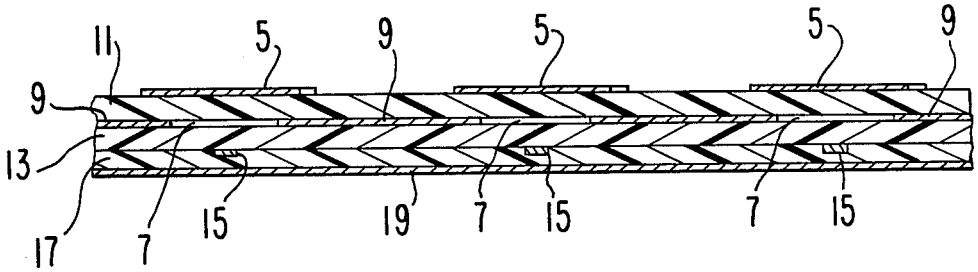
FIG. 7 is a side cross-sectional view corresponding to the FIG. 6 embodiment.

Excitation slot 7 does not have to be part of a waveguide wall as in FIG. 1. Rather, it could be a slot in a ground plane 9 fed by a microstrip feed network 15 as in FIGS. 4 and 5, or stripline 15 as in FIGS. 6 and 7. In these embodiments, the excitation slots 7 are once again positioned so that their long axes are orthogonal to the E field, in order to avoid loss. This is accomplished by making the long axes of the slots 7 orthogonal to the long dimension of the microstrip 5 or stripline conductor 15, since the current in conductors 15 flows along their long axes.

The microstrip embodiment differs from the waveguide embodiment in that in lieu of waveguide ensemble 1 is the combination of a planar ground plane 9 in which the apertures 7 are cut, and a planar dielectric layer 13 is positioned beneath the ground plane layer 9. Mounted on the underside of dielectric layer 13 is the microstrip feed network 15.

The dimensions of the radiating patches 5 and the bandwidth of the antenna are primarily dependent upon the thickness and the dielectric constant of the first dielectric layer 11 and not of the second dielectric layer 13. The second dielectric layer 13 serves to support the microstrip conductors 15 and to impedance match said conductors 15 to the patches 5. This is done by changing the thickness and/or the dielectric constant of layer 13. The dimensions of slots 7 are fine tuned by taking into account the presence of both upper dielectric layer 11 and lower dielectric layer 13.

The stripline embodiment (FIGS. 6 and 7) differs from the microstrip embodiment in that a third planar dielectric layer 17 is positioned beneath the conductive feed network 15, and a second planar ground plane 19 is positioned beneath the third dielectric layer 17. Conductive feed network 15 is now called stripline or barline because it is positioned between two ground planes 9, 19.

Usually the third dielectric layer 17 is fabricated from the same material as the second dielectric layer 13, but these two layers do not have to be fabricated from the same material as dielectric layer 11. This is one example of how the radiating side of the antenna can be designed and optimized separately, albeit interdependently, of the feed network side, which is a major advantage of this invention compared with the prior art.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. An antenna element for generating circularly polarized electromagnetic signals, comprising:

a single elongated excitation aperture cut in a planar conductive ground plane;

in spaced parallel relation to the ground plane and completely covering the excitation aperture when viewed from a direction orthogonal to the ground plane, a planar conductive radiating patch havng slightly different dimensions along each of two orthogonal axes, with each said dimension being greater than the length of the excitation aperture; and a first planar dielectric layer separating the ground plane and the aperture from the radiating patch; wherein the excitation aperture forms an angle of substantially 45°, viewed from a direction orthogonal to the plane of the radiating patch, with respect to each of the two orthogonal axes of the radiating patch; whereby exciting the aperture with linearly polarized electromagnetic energy causes the radiating patch to generate a circularly polarized electromagnetic signal consisting of two orthogonal cmponents that have substantially the same amplitude and are 90° offset in phase from each other.

2. The apparatus of claim 1 wherein the radiating patch has the shape of a rectangle that is nearly a square.

3. The apparatus of claim 2 wherein each side of the rectangle has a length approximately equal to half of a wavelength of the electromagnetic signal generated by the antenna, said wavelength taking into account the presence of the dielectric layer.

4. The apparatus of claim 1 wherein the radiating patch has the shape of an ellipse, and the angle between the aperture and the major axis of the ellipse is 45°.

5. The apparatus of claim 1 wherein the ground plane constitutes one of four walls of an elongated conductive waveguide.

6. The apparatus of claim 1 further comprising a second planar dielectric layer having first and second sides, the first side touching a surface of the ground plane that is not touching the first dielectric layer and the second side supporting a microstrip feed network.

7. The apparatus of claim 1 further comprising a second planar dielectric layer having first and second sides, the first side touching a surface of the ground plane that is not touching the first dielectric layer and the second side supporting a stripline feed network.

8. Apparatus comprising several antenna elements of claim 1 combined in an array having a repeating geometrical pattern and an aperture larger than the aperture of any single antenna element.

* * * * *